US010506899B2

(12) United States Patent
Szutkowski

(10) Patent No.: US 10,506,899 B2
(45) Date of Patent: Dec. 17, 2019

(54) MOVABLE BATHTUB ASSEMBLY

(71) Applicant: Shutek Förvaltning AB, Järfälla (SE)

(72) Inventor: Janusz Szutkowski, Järfälla (SE)

(73) Assignee: Shutek Förvaltning AB, Järfälla (SE)

( * ) Notice: Subject to any disclaimer, the term of this patent is extended or adjusted under 35 U.S.C. 154(b) by 0 days.

(21) Appl. No.: 16/300,083

(22) PCT Filed: Oct. 30, 2017

(86) PCT No.: PCT/PL2017/000108
§ 371 (c)(1),
(2) Date: Nov. 9, 2018

(87) PCT Pub. No.: WO2018/080329
PCT Pub. Date: May 3, 2018

(65) Prior Publication Data

US 2019/0142224 A1 May 16, 2019

(30) Foreign Application Priority Data

Oct. 31, 2016 (PL) ..... P.419326

(51) Int. Cl.

| | |
|---|---|
| ***A47K 3/00*** | (2006.01) |
| ***A47K 3/20*** | (2006.01) |
| ***A61H 33/00*** | (2006.01) |
| ***A47K 3/06*** | (2006.01) |
| *A47K 3/12* | (2006.01) |

(52) U.S. Cl.
CPC ..... *A47K 3/007* (2013.01); *A47K 3/06* (2013.01); *A47K 3/20* (2013.01); *A61H 33/00* (2013.01); *A47K 3/122* (2013.01)

(58) Field of Classification Search
CPC ..... A47K 3/007
See application file for complete search history.

(56) References Cited

U.S. PATENT DOCUMENTS

| | | | |
|---|---|---|---|
| 535,509 | A | 3/1895 | Ruby |
| 760,540 | A | 5/1904 | Lancaster |

(Continued)

FOREIGN PATENT DOCUMENTS

| | | | |
|---|---|---|---|
| EP | 0284644 | A2 | 10/1988 |
| NL | 1022869 | C1 | 9/2004 |

(Continued)

OTHER PUBLICATIONS

Visegrad Patent Institute/Branch Office PL, Warsaw, Poland, International Search Report of International Application No. PCT/PL2017/000108, dated Jan. 29, 2018, 3 pages.

*Primary Examiner* — Janie M Loeppke
(74) *Attorney, Agent, or Firm* — Brinks Gilson & Lione

(57) ABSTRACT

Movable bathtub assembly characterized in that all arms, joints and mechanism mounting structures are arranged below an upper edge (29) of a bathtub (1) supported by its legs (7) on a base (30) and situated in the bathing position, in principle horizontally, completely inside the space defined by the upper edge (29) of the bathtub (1), the base (30) and walls (36) adjusted to the bathtub (1), in such way, that the bathtub is displaced following the rotation of arms (2, 3) from its bathing position to its vertical position, where the concave side of the bathtub is directed towards the place of its center in the bathing position.

9 Claims, 11 Drawing Sheets

(56) References Cited

U.S. PATENT DOCUMENTS

| | | | | | |
|---|---|---|---|---|---|
| 1,235,091 | A | | 7/1917 | Anderson | |
| 2,514,848 | A | | 7/1950 | Davis | |
| 2,536,540 | A | * | 1/1951 | Davis | A47K 3/007 4/540 |
| 3,174,160 | A | * | 3/1965 | Fielding | A47K 3/007 4/540 |
| 4,530,121 | A | * | 7/1985 | Penney | A47K 3/007 4/540 |
| 6,378,145 | B1 | | 4/2002 | Wyss | |

FOREIGN PATENT DOCUMENTS

| | | | |
|---|---|---|---|
| NL | 1027535 | C1 | 5/2006 |
| WO | 2004012568 | A1 | 2/2004 |
| WO | 2011155856 | A1 | 12/2011 |

* cited by examiner

MOVABLE BATHTUB ASSEMBLY

CROSS REFERENCE TO RELATED APPLICATIONS

This application claims priority to PCT/PL2017/000108 filed on Oct. 30, 2017, which claims priority to Polish Patent Application No. P.419326 filed on Oct. 31, 2016, the entire contents of each herein incorporated in their entirety by reference.

FIELD

The present disclosure concerns a movable bathtub assembly suitable for, among others, in private homes, in rest-homes and in hospitals.

BACKGROUND

The statements in this section merely provide background information related to the present disclosure and several definitions for terms used in the present disclosure and may not constitute prior art.

U.S. Pat. No. 535,509A discloses a bathtub lifted to the wardrobe interior by means of a tie connected to the shorter bathtub wall with a more gently incline (further indicated by letter "L"), by means of vertical guides on its both sides, leading the bathtub by means of movable joints fixed to the upper part of the bathtub L. This displacement is aided by a counterweight of the bathtub fixed at the other end of the tie passing through a pulley in the upper part of the internal wall of the wardrobe. By this method the bathtub is placed in the wardrobe with its concave side facing outside. The bathtub is provided with a folded leg.

U.S. Pat. No. 760,540A describes a bathtub lifted to the wardrobe interior manually using a hinge fixed to the base of the bathtub, at the edge connected to the wardrobe. The bathtub is stored with its concave side towards the wardrobe interior.

U.S. Pat. No. 1,235,091A presents a bathtub converted into a shower cabin, having a folded shower head and fittings arranged inside the bathtub on one of its side walls. The bathtub is turned with its concave side towards already existing shower space outside the bathtub contour in its vertical position. The shower head directs water jets to the bathtub interior, whereas the bathing person should stand in the center of the bathtub positioned vertically. This solution does not limit the space utilized in the bathroom. It requires a very long, wide and deep bathtub to form a shower cabin meeting necessary ergonomic standards.

International Patent Publication No. WO2004012568A uses, in its first part, one joint to rotate a bathtub to the vertical position, forming a semi-inclined rotatable wall of a shower cabin. In its second part, it utilizes an arm hooked to the shower housing above the upper edge of the bathtub in the horizontal position, in order to manipulate the said bathtub to its vertical position with additional help of guides on both sides of the bathtub, to close the shower cabin while bathing.

U.S. Pat. No. 2,514,848A presents a bathtub for medical treatment enabling the introduction of a patient into the bathtub in its vertical position and rotation of the bathtub to its horizontal position. Simultaneously it is raised to the height convenient for carrying out the treatment. This solution utilizes an arm hooked at one side to the bathtub base and on the other side through a joint to bolt and nut mechanism driving its rotary-sliding displacement around an axis fixed to the ground and passing through a longitudinal slot in the arm. The bathtub trajectory is defined by the movement of the arm.

U.S. Pat. No. 6,378,145B1 proposes a combination of a bathtub and a shower cabin with a mechanism pulling a bathtub. There are utilized guides under the bathtub and on the bathroom wall from bathtub wall. The bathtub moves on the guides by means of wheels mounted to its base driven by an electric motor.

The known solutions force the user, having a limited space, to choose between a separate shower space and a bathtub, whereas option of a bathtub with a shower fitting is bound to many disadvantages, i.e. the high wall of the bathtub, a limited space in the bathtub, and the necessity of using a bath curtain instead of a permanent partition, as well as, very often, a dangerous surface of the bathtub bottom. In the bathroom arrangement with both a bathtub and a shower cabin there is doubling of the necessary fittings and mountings, which is particularly expensive in case of both these devices having massage functions. Additionally, we also need to use a shower in a sitting position, which is particularly important to elderly or/and disabled persons and during leg washing. To that aim we must keep a stool in the bathroom occupying additional space. Keeping the bathroom clean is often difficult as some parts of the floor under the bathtub are inaccessible.

SUMMARY

The aim of the present invention present disclosure generally addresses the problem by providing a device that allows transporting correctively ribbon-shaped substrates with completely different widths.

The present disclosure generally addresses the problems by providing a solution, which enables using both a bathtub and a separate shower space without the disadvantages of the conventional art.

According to one aspect of the present disclosure, a movable bathtub assembly comprises a bathtub and a mechanism to displace it. This mechanism comprises at least one arm connected with the bathtub at one of its ends by means of at least one articulated joint, and connected with a base and/or a wall at the second of its ends by means of at least one articulated joint, is characterized in that all arms, joints and mechanism mounting structures are arranged below an upper edge of the bathtub supported by its legs on a base and situated in the bathing position, in principle horizontally, completely inside the space defined by the upper edge of the bathtub. The base and the walls are adjusted to the bathtub, in such way, that the bathtub is displaced following the rotation of the said arms from its bathing position to its vertical position, where the concave side of the bathtub is directed towards the place of its center in the bathing position.

According to another aspect of the present disclosure, the arms are displaced by means of at least one from the following: a motor, an actuator, manually, a spring and/or their combination.

According to another aspect of the present disclosure, the movable bathtub assembly comprises two pairs of arms, each on the opposite side of the bathtub, whereas each arm is connected at one side, via an arm, to the base and/or to the wall, correspondingly, by means of an articulated joint and is connected at the other side, via a bed, to the bathtub by means of an articulated joint. The arms and the bathtub form a four-bar linkage with oscillating links defining the bathtub trajectory. The movement of the arms is synchronized on both sides of the bathtub by the stiff connection of one arm from the first pair to the corresponding arm from the second pair by means of a coupling element.

According to yet another aspect of the present disclosure, the movable bathtub assembly comprises a pair of legs connected to the bathtub by means of articulated joints, directly or indirectly via the bed, advantageously foldable by means of a mechanism arms, directly or indirectly via a leg coupling element.

According to another aspect of the present disclosure, the movable bathtub assembly comprises at least one of the following elements: the bathtub handles, an installation system coupling the bathtub with the mechanism frame along the bathtub lateral sides and a lock blocking the bathtub in the bathing position and in the vertical position. The installation system enables a stable and comfortable connection of the bathtub and the mechanism, without the need to access this mechanism from the bathtub lateral sides. This system utilizes the shape relation between the bathtub and the mechanism as well as the gravitation force, so in order to disconnect the bathtub from the said mechanism one needs to move the bathtub in the vertical position, first basically up, and then basically outside from the mechanism. The lock utilizes the space relation between the mechanism arm shape near the joint, fixing the said mechanism to the bathtub, and the shape of the bathtub handle as well the action of the spring. In order to unblock the arm and initiate its movement in relation to the handle, so to transfer the bathtub from the vertical position to the bathing position and vice versa, in the vertical position one must apply force vertically upwards to the said handle and in the bathing position one must apply force horizontally outwards from the bathtub.

According to another aspect of the present disclosure, the bathtub in the bathing position is used for the air-water massage and the bathtub in the vertical position is used for the shower massage, comprising, in any combination, elements chosen from the group comprising: water and air nozzles, valves, a thermostat, a hand shower head with a grip, situated on the rim of the said bathtub and provided with a flexible feed tube, a main switch valve directing the water flow to the chosen device, a control panel to choose and control the massage function, a feed-control system, and the bathtub inclination detector.

According to still another aspect of the present disclosure, the bathtub is provided with a sliding shower head mounted on the rim of the said bathtub, on the wall side, having such shape that it provides a headrest for a bathing person, when the bathtub is in the bathing position, whereas in the vertical position it is moved out to such height that it can be used as an upper shower by a person standing next to the bathtub. While lowering the bathtub to the bathing position the sliding shower head is stowed away behind the bathtub wall.

According to another aspect of the present disclosure, sewage removal system connects the bathtub outlet hole, with the bathtub in the bathing position, to sewage outflow point in the base, via the system comprising pipes and/or flexible tubes and a mushroom discharge outlet concentrically folded in the vertical positon of the bathtub.

According to another aspect of the present disclosure, the bathtub lower wall in the vertical position of the bathtub is situated with its central part at such height above the base and having such shape that it constitutes a seat.

According to another aspect of the present disclosure, the movable bathtub assembly comprises protective and decorative cover plates covering the bathtub side walls and the mechanism on both sides of the bathtub.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will now be described in detail using an example of embodiment of the invention with reference to the drawings. The drawings described herein are for illustration purposes only and are not intended to limit the scope of the present disclosure in any way.

DETAILED DESCRIPTION

Figure 1:
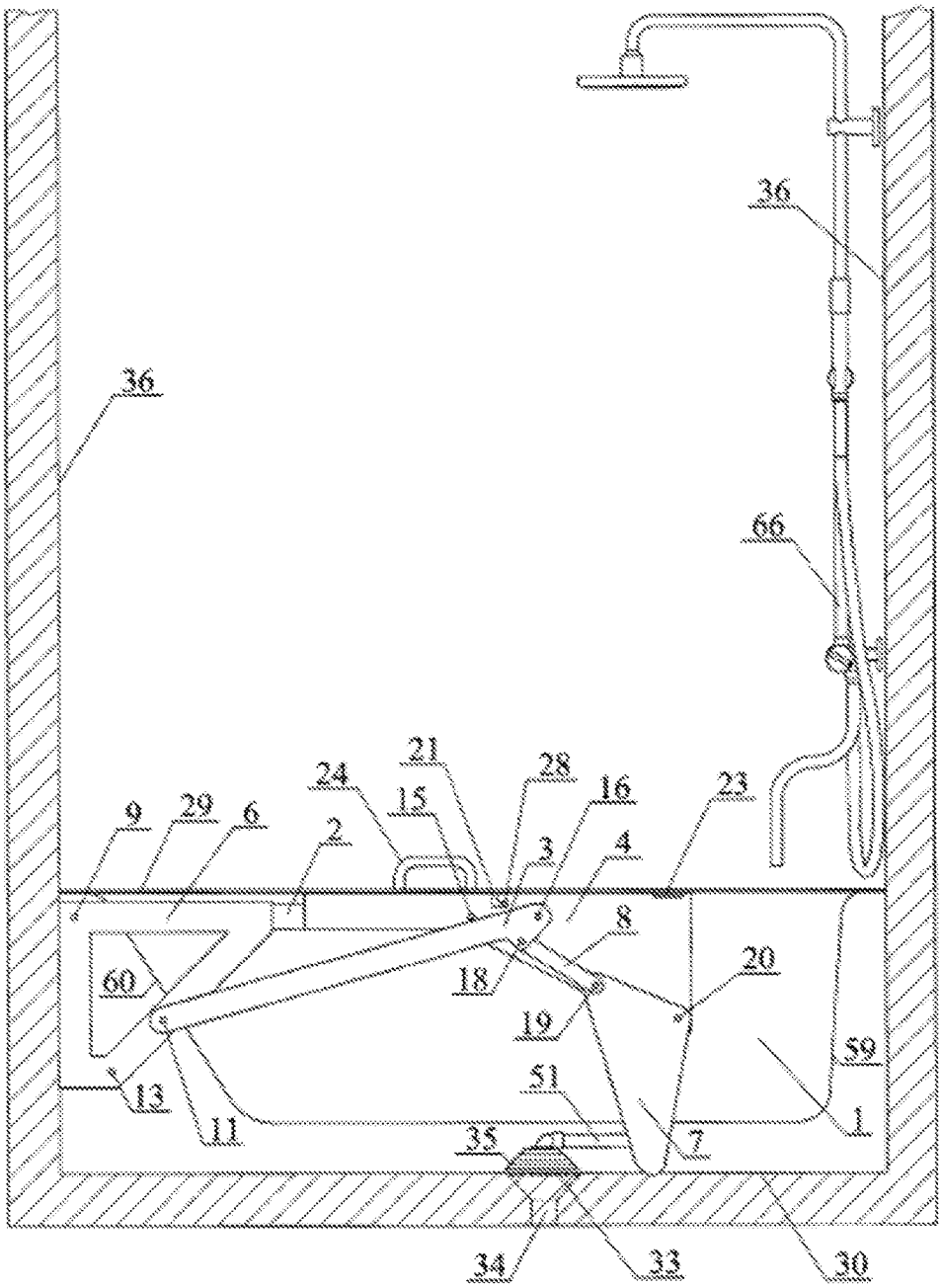
FIG. 1 presents the side view of the bathtub assembly without fittings, in the horizontal position, with the uncovered four-bar linkage with oscillating links mechanism (the rocker mechanism) and the sewage removal system.

The following description is merely exemplary in nature and is in no way intended to limit the present disclosure or its application or uses. It should be understood that throughout the description, corresponding reference numerals indicate like or corresponding parts and features.

Figure 2:
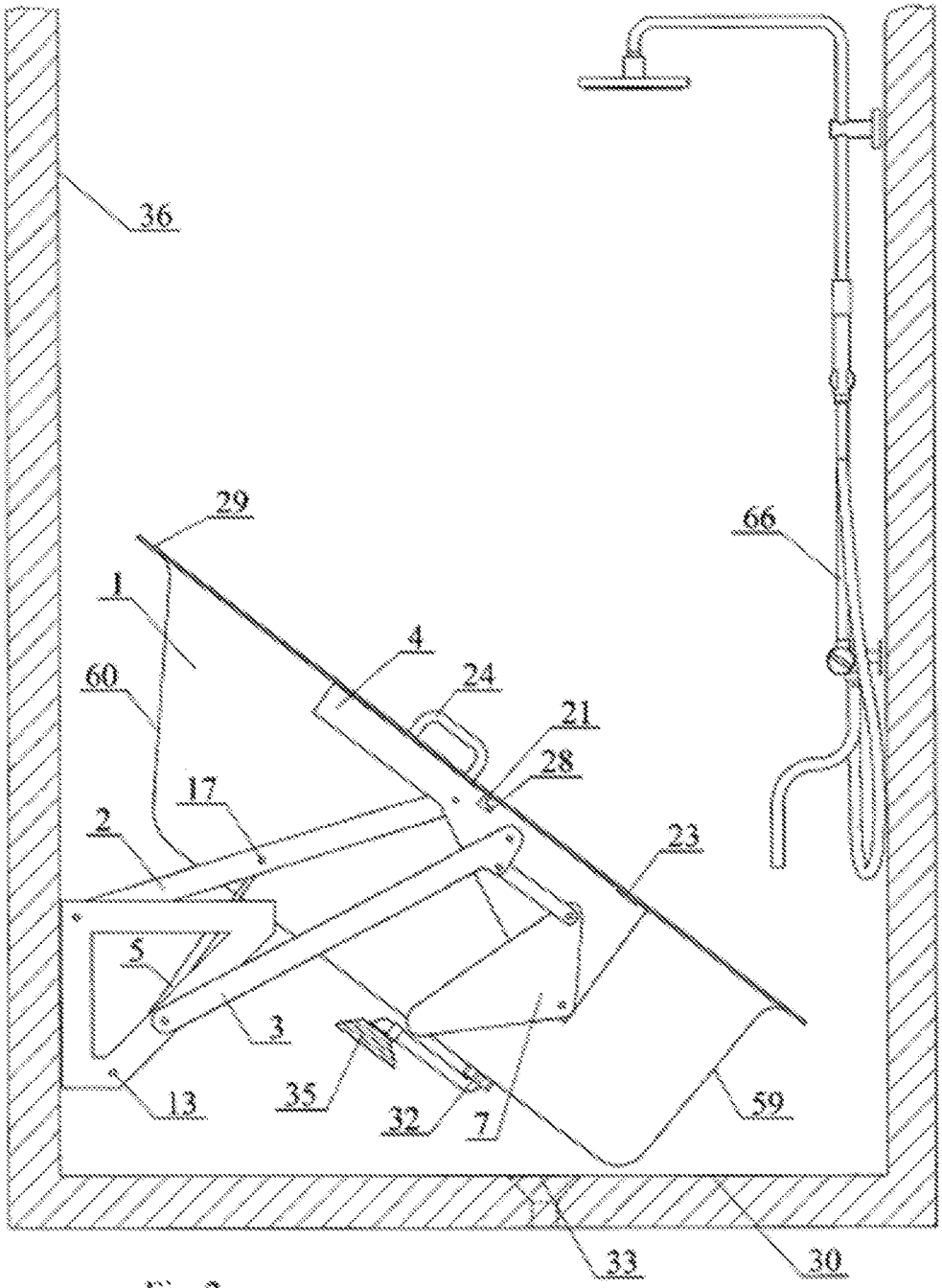
FIG. 2 presents the side view of the bathtub assembly without fittings, in the transfer position, between the horizontal position and the vertical position, with the uncovered four-bar linkage with oscillating links mechanism (the rocker mechanism) and the sewage removal system.
Figure 3:
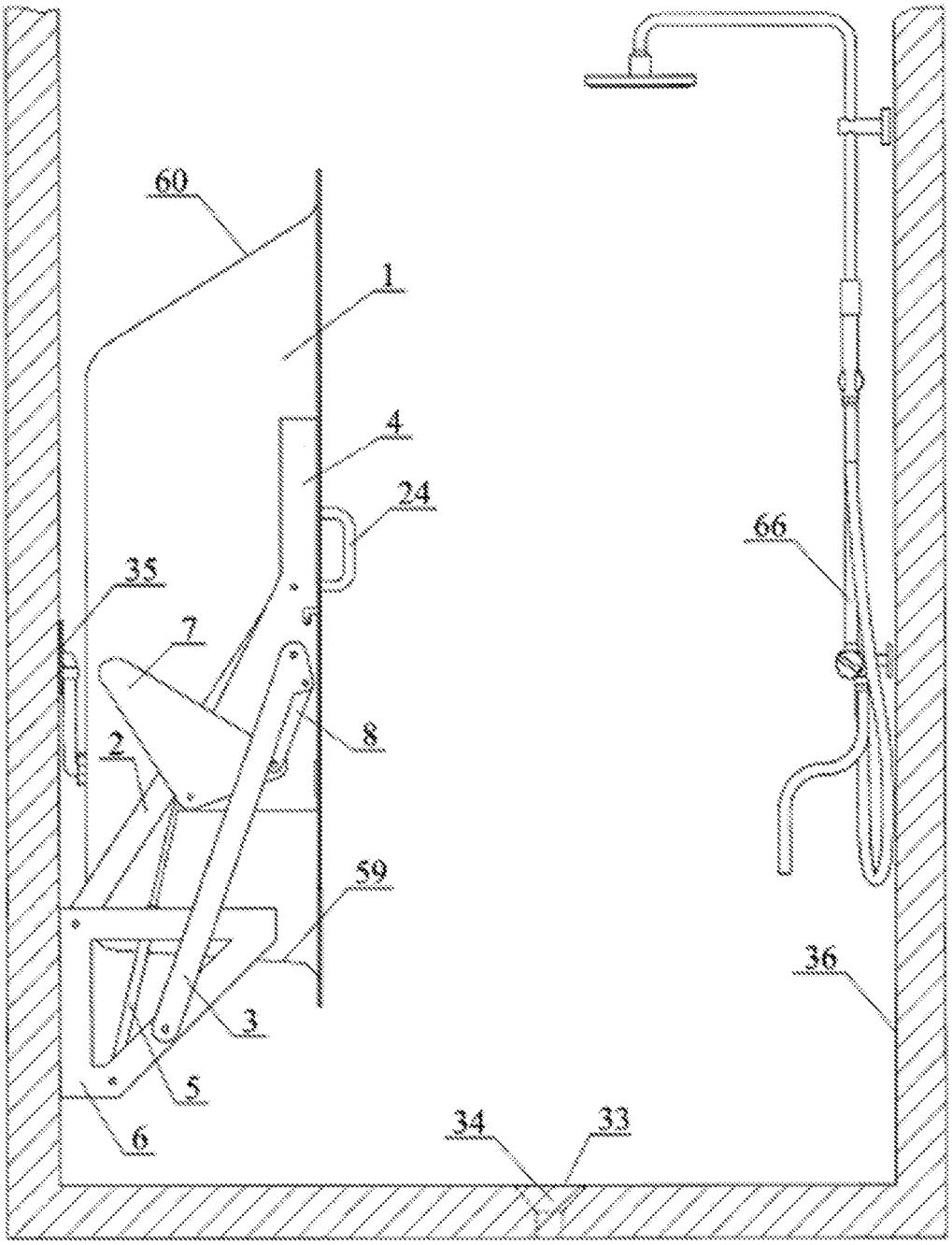
FIG. 3 presents the side view of the bathtub assembly without fittings, in the vertical position, with the uncovered four-bar linkage with oscillating links mechanism (the rocker mechanism) and the folded sewage removal system.

Referring to FIG. 1, the side view of the bathtub 1 assembly is shown without fittings, in the horizontal position, with the uncovered four-bar linkage with oscillating links mechanism (the rocker mechanism) and the sewage removal system. FIG. 2 and FIG. 3 present the same bathtub assembly, correspondingly, in the transfer position and in the vertical position. The bathtub 1 in FIG. 1 is arranged relatively tight between the hypothetic walls 36 of a room equipped with a shower set 66, arranged on the wall above the side 59 of the bathtub 1. The mechanism can be seen without cover plates 52 and 53 covering it (see FIG. 14 and FIG. 15). One should observe that the presented mechanism is in principle symmetric on both sides of the bathtub 1.

This mechanism, constituting a four-bar linkage, is formed by a wall frame 6 coupled with the leading arm 2 via the articulated joint 9 and with the following arm 3 via the articulated joint 11 on both sides of the bathtub 1, whereas both arms are joined to a bed 4 of the bathtub 1 by means, correspondingly, of the articulated joints 15 and 16. The angular rotation of the leading arm 2 upwards is followed by the following arm 3, via the articulated joints 15 and 16 in the bed 4. The following arm 3, being the shorter than the leading arm 2 and fixed by the articulated joint 11 to the stationary frame 6, forces the bed 4 to rotate around the articulated joint 15 in such way, that its upper edge moves slowly form the position parallel to a base 30 and to the leading arm 2 to the position perpendicular to the base (FIG. 2 and FIG. 3). The shape of a trajectory obtained in that way is defined unambiguously by all geometric dimensions of the system, it means the length of the arms 2 and 3, the interspace and the position of their articulated joints 15 and 16 in the bed 4 and the position of their articulated joints 9 and 11 in the stationary frame 6.

Figure 4:
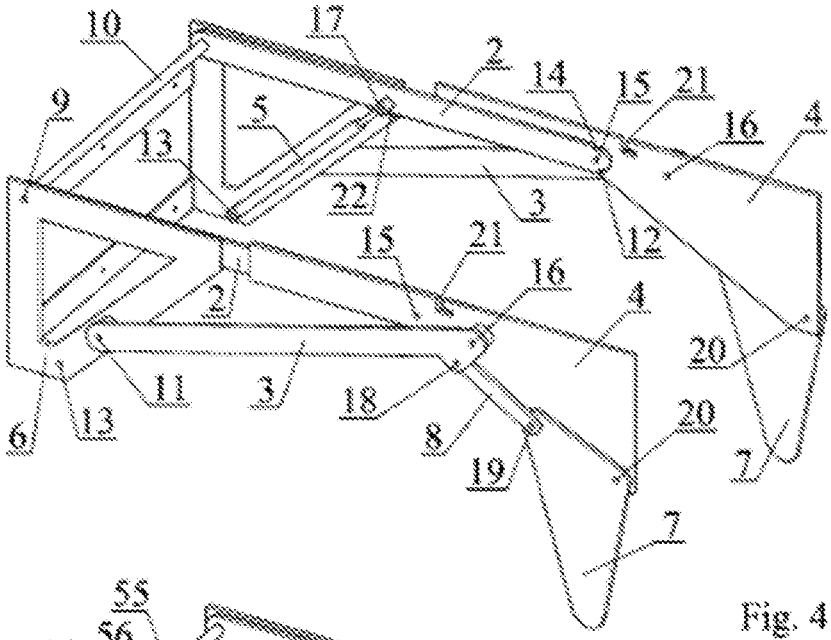
FIG. 4 presents the perspective view of the four-bar linkage with oscillating links mechanism (the rocker mechanism), partially disassembled, with the bathtub removed.

The leading arms 2 arranged on both sides of the bathtub 1 are permanently joined together by means of a coupling element 10 (see FIG. 4) situated coaxially with the articulated joints of the arms 2 in the frame 6. The coupling element 10 synchronizes the movement of the said arms, and, which follows, the movement of both systems on both sides of the bathtub 1.

The weight of the bathtub 1 in the horizontal position (FIG. 1) rests on beds 4 and, via articulated joints 20, on a pair of folded legs 7, which are kept in a vertical position at one side by means of the coupling arms 8 and articulated joints 19 arranged on the legs 7, as well as articulated joints 18 arranged within the following arm 3 contour, and at the other side by means of articulated joints 15 and the leading arms 2 supported on stops 22 (see FIG. 4) and by means of the articulated joints 9 arranged on the frame 6 fixed to the wall 36.

The bathtub 1 fixed to the bed 4 rotates together with the bed 4 during its rotation caused by movement of the arms 2 and 3, from the horizontal position (FIG. 1) through the transfer position (FIG. 2) to the vertical position, in which the concave side of the bathtub 1 is directed towards the place of its center in the horizontal (bathing) position (FIG. 3).

Movement of the following arm 3 in relation to the bed 4, via the coupling arm 8 and its articulated joints 18 and 19 in the arm 3 and in the leg 7 forces rotation of the leg 7 around its articulated joint 20 in the bed 4 (symmetrical on both sides of the bathtub). Accordingly, when the bathtub 1 travels upwards the legs 7 are automatically folded within its side contour, and during its movement downwards they unfold to form the support of the bathtub 1 in its horizontal position (FIG. 1, FIG. 2, and FIG. 3). The legs 7 have to fold, otherwise the bathtub 1 would engage the base 30, and in order to place the bathtub 1 in the vertical position closer to the wall 36 than it is placed in relation to the base 30 in the horizontal position. It also serves to further optimize the use of space in the room.

In the presented solution, movement of the leading arm 2 and the bathtub 1 is caused by hand operation applied via the handles 24 arranged in the central part of the bathtub 1 on its rim 29, and by the combination of the mutually opposing forces of gravitation and of pneumatic springs 5, which during the bathtub movement from the horizontal position to the vertical position are expanded and lengthened, while during its reverse movement they are compressed and shortened (FIG. 1). The manual force necessary to manipulate the said bathtub is inconsiderable, as it only compensates the difference between the forces from the gravitation and from the springs.

The springs 5 are at one side supported in the frame 6 by the articulated joints 13 and at the other side are coupled with the leading arms 2 via the articulated joints 17 (see FIG. 2 and FIG. 3) arranged in the central part of the said arms 2. The weight of the bathtub 1 compresses the springs 5 via the beds 4 and the leading arms 2 coupled with them by means of the articulated joints 2 (see also FIG. 4).

The springs 5 counter the compression force. They are selected in such way that they balance the weight of the bathtub 1 together with the mechanisms, and they can slightly raise the empty bathtub in its horizontal position (weight around 20 kg). Accordingly, on the leading arms 2 near the articulated joints 15 there are arranged recesses 14 (see FIG. 4 and FIG. 11, FIG. 12 and FIG. 13) engaging locking bolts 26, constituting parts of the maneuvering handles 24, which extend between the said arms and the rim 29 of the bathtub 1 urged by the springs 25 supported on the limiting plates 27, as shown in FIG. 11 presenting the side view of the bathtub maneuvering handle 24 of the bathtub 1 blocking the arm 2 in the horizontal position.

Figure 11:
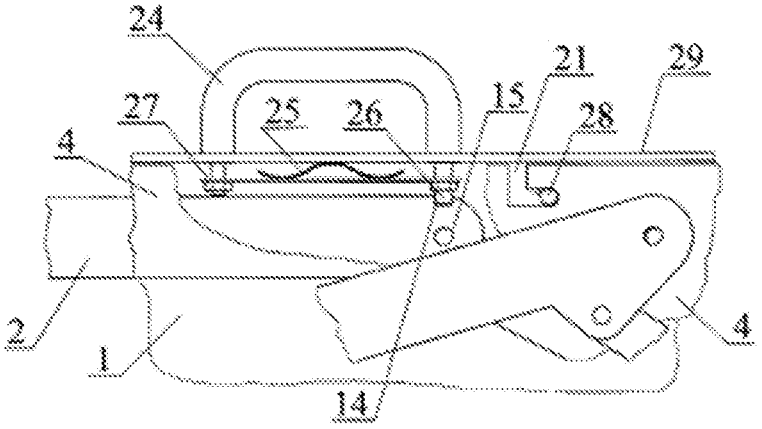
FIG. 11 presents the side view of the bathtub maneuvering handle blocking the arm in the horizontal position.
Figure 12:
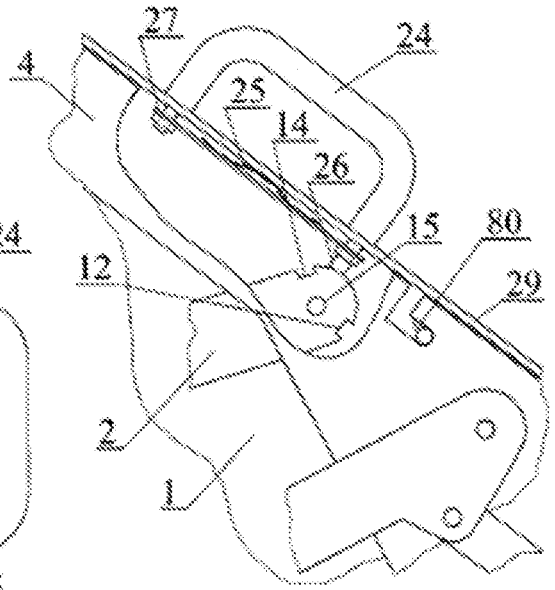
FIG. 12 presents the side view of the bathtub maneuvering handle with the arm blockage, in the transfer position, between the horizontal position and the vertical position.
Figure 13:
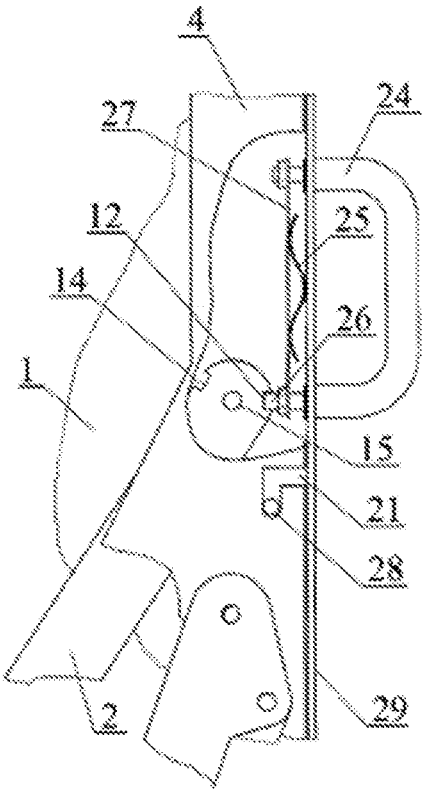
FIG. 13 presents the side view of the bathtub maneuvering handle blocking the arm in the vertical position.

The said locking bolts 26 and the recesses 14 form the part of the lock, preventing the angular displacement of the bathtub 1 in relation to the arm 2, i.e. keeping the bathtub 1 in the horizontal position. The blockage (the lock) can be obtained in many similar ways (for example with elements protruding from the leading arm instead of recesses). Notwithstanding the implementation, it is always the shape relation of the handles 24 and the leading arm 2 as well as the spring 5, which directly or indirectly block the bathtub in the horizontal position.

Where the bathtub 1 is in the horizontal position (FIG. 1), pulling the maneuvering handles 24 upwards causes compression of the springs 25 and removal of the locking bolts 26 from the recesses 14 (FIG. 11). The bathtub is slightly raised, which causes the small rotation of the leading arms 2, and the locking bolts 26 are supported on the rounded surfaces of the arms around the articulated joints 15, on which they slide during the further upwards movement of the bathtub (FIG. 12). After the bathtub 1 has reached the position close to the vertical one, the operator must push the bathtub towards the wall 36. When the locking bolts 26 find the recesses 12 defining the vertical position, the spring 25 decompresses and the bathtub is blocked in the position, until the handles are pulled in the opposite direction (FIG. 13). Even additional burdening the bathtub in any direction will not cause its displacement.

As it has already been explained, the bathtub 1 is supported with its rim 29, along its longer sides on beds 4, and its position is defined by the stops 23 and the pins 28 fixed directly to the bathtub 1 (for example screwed in or glued in), which are seated in seats 21 cut out in the said beds 4 (FIG. 1 and FIG. 11, FIG. 12 and FIG. 13). The seats 21 together with the pins 28 and the stops 23 form the connecting system, and the "L" shape of the seats realizes the option of mounting and demounting the bathtub 1, where the bathtub is in the position near vertical (FIG. 3). In the present disclosure it is important, that the said mounting and demounting can be carried out without the access to the maneuvering mechanism from the lateral sides of the bathtub 1, as it may be hidden behind the structures adjusted to the bathtub 1 (for example plates).

Figure 14:
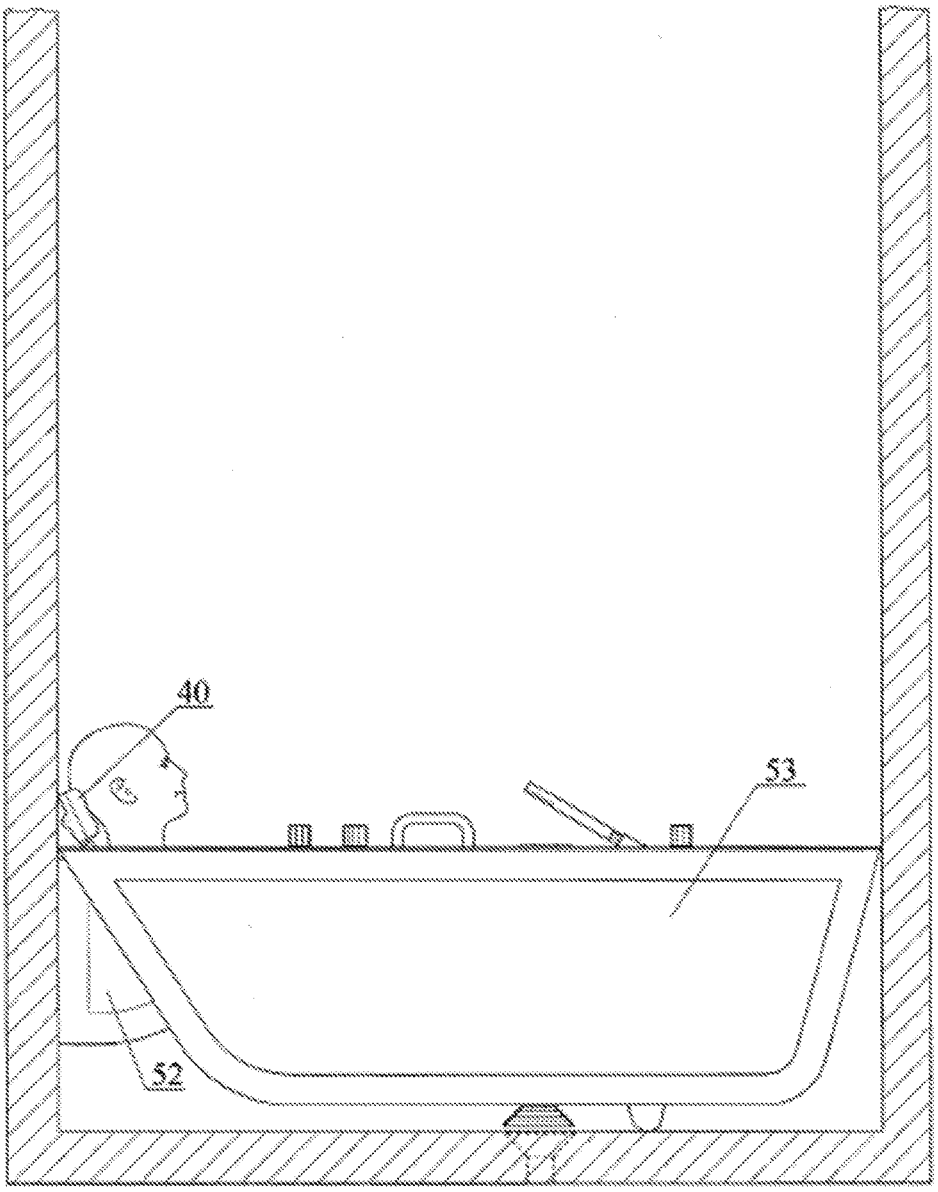
FIG. 14 presents the side view of the bathtub assembly in the horizontal position, covered with the protective cover plates, with a bathing person supporting his head on the headrest formed by the lowered shower head.

The demounting process of the bathtub 1, being in the position near vertical, from its beds 4, comprises its lifting by pulling the handles 24 upwards and removing from the seats 21 by pulling the handles 24 towards the operator. The bathtub 1 cannot be removed from the beds 4 when the locking bolts 26 are in the recesses 12 or 14. In order to prevent accidental removal of the bathtub 1 during its manual lifting from the horizontal position to the vertical position, the gravitationally advanced latch 80 has been arranged on the upper edge of the seat 21. The latch 80 blocks pins 28 in their seats with its weight (FIG. 11 and FIG. 12) releasing them only when the bathtub 1 reaches the position near vertical, whereas the operator normally pushes the handles 24 instead of pulling them upwards. To further facilitate the bathtub 1 montage, one can introduce the limiters (not shown) of the maximal inclination of the following arms 3 in the frame 6, which can be also used as the construction elements for the cover plates 52 (FIG. 14 and FIG. 15).

Figure 5:
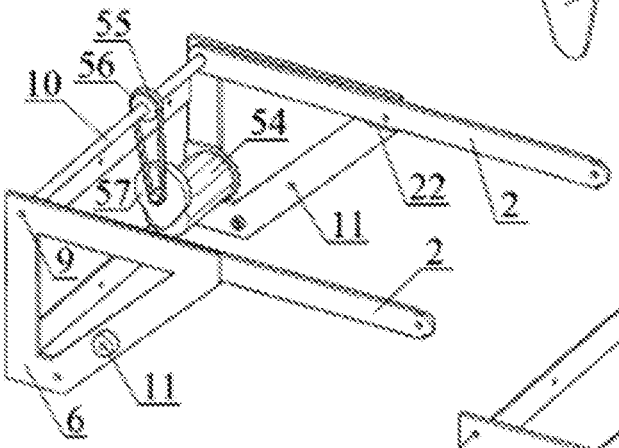
FIG. 5 presents the perspective view of the mechanism frame showing an exemplary motor mounted with a transmission.

FIG. 5 presents, in the perspective view, the mechanism frame showing an exemplary motor 54 mounted with a transmission. In this case, the motor 54 via a reduction gear 57, a driving belt or a driving chain 55 and a receiving wheel 56 mounted on the coupling element 10, connecting the leading arms 2, drives the arms 2, and by their means the bathtub 1 using electric energy. The work of the motor 54 can be controlled by a control system (not shown) utilizing terminal switches or inclination angle indicators.

Figure 6:
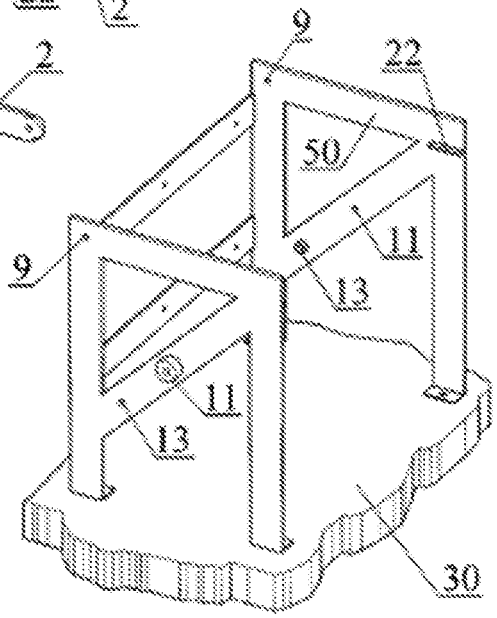
FIG. 6 presents the perspective view of the mechanism frame mounted to the base.

To drive the mechanism one can also use pneumatic or hydraulic actuators, mounted, for example, instead of the pneumatic springs. In most cases a standard construction of a bathroom wall should provide sufficient support for the half weight of the bathtub filled with water (around 100 kg) distributed among all fixing points of the frame 6, in the generally vertical direction (shear load). If the construction of the wall is not sufficient one can use the frame 50 fixed to the base 30, which exemplary construction has been shown in FIG. 6.

Figure 15:
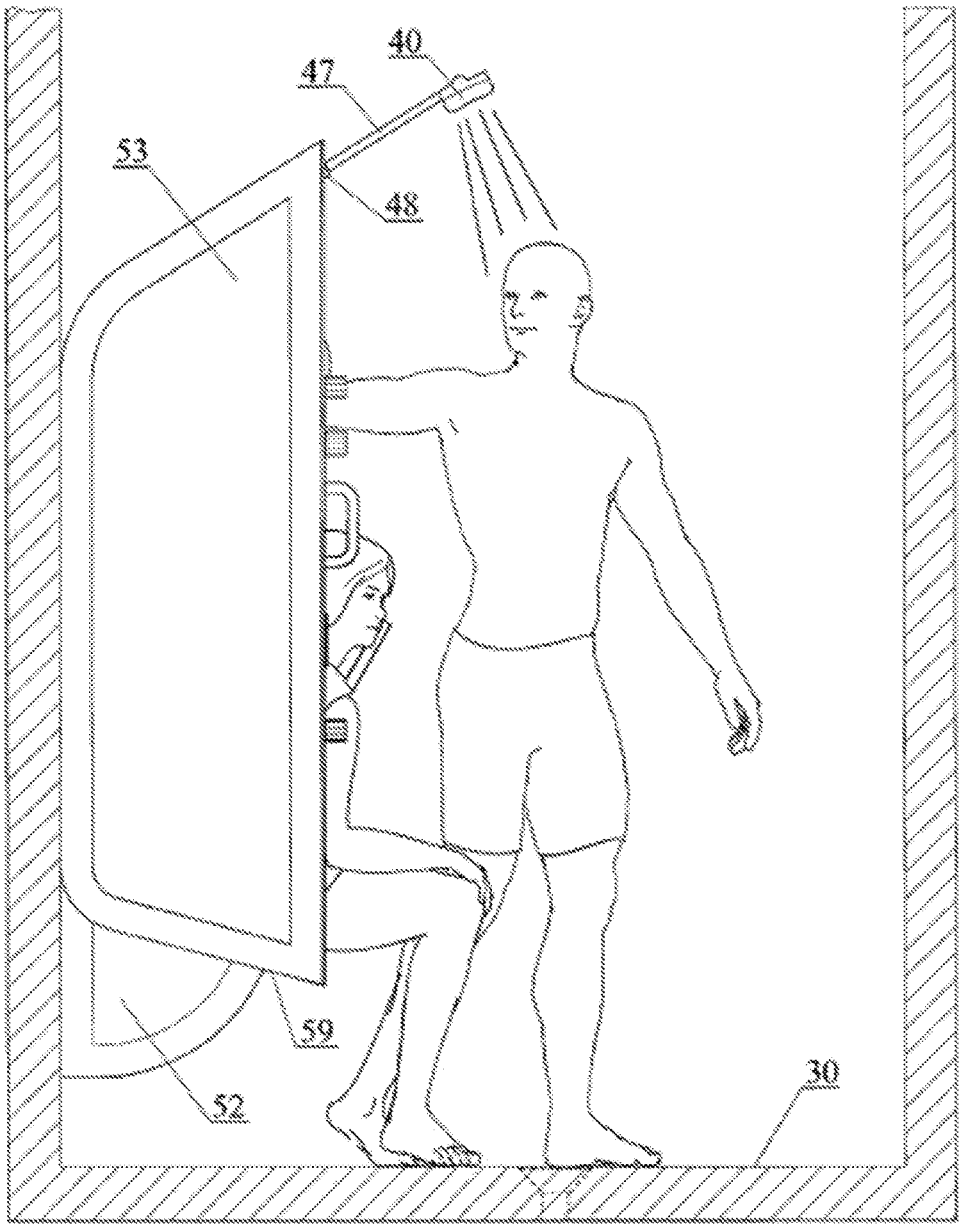
FIG. 15 presents the side view of the bathtub assembly in the vertical position, covered with the protective cover plates, with a sitting bathing person and a standing bathing person using the advanced shower head.

The above described bathtub 1 maneuvering mechanism could be constructed in such way (by selection of the length of the arms 2 and 3 or the arm 69 (see FIG. 16 and FIG. 17), fixing points, articulated joints, dimensions of the bathtub 1 and the shape of its wall 59), that when the bathtub 1 is in the vertical position, the surface of its wall 59 is arranged at such height and has such shape that it is suitable for sitting (FIG. 15). To meet the conditions of comfortable sitting, the height of the wall 59 above the base, when the bathtub 1 is in the vertical position, should be within the range from 0.45 m to 0.55 m, and the surface of the wall 59 should be in principle parallel to the base 30, possibly with a small indentation in its central part.

An opportunity to maneuver the bathtub 1 from the horizontal position to the vertical position and to seat on its lower wall 59 then, implies new applications and new technical solutions of the present disclosure. They are connected to its massage and shower functions.

Figure 7:
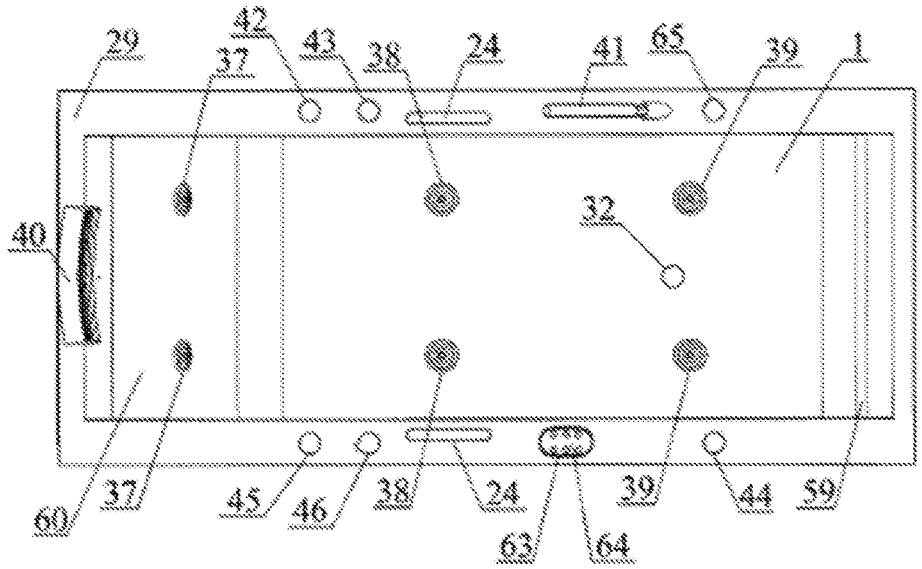
FIG. 7 presents the top view of the bathtub assembly with massage fittings, in the horizontal position.
Figure 8:
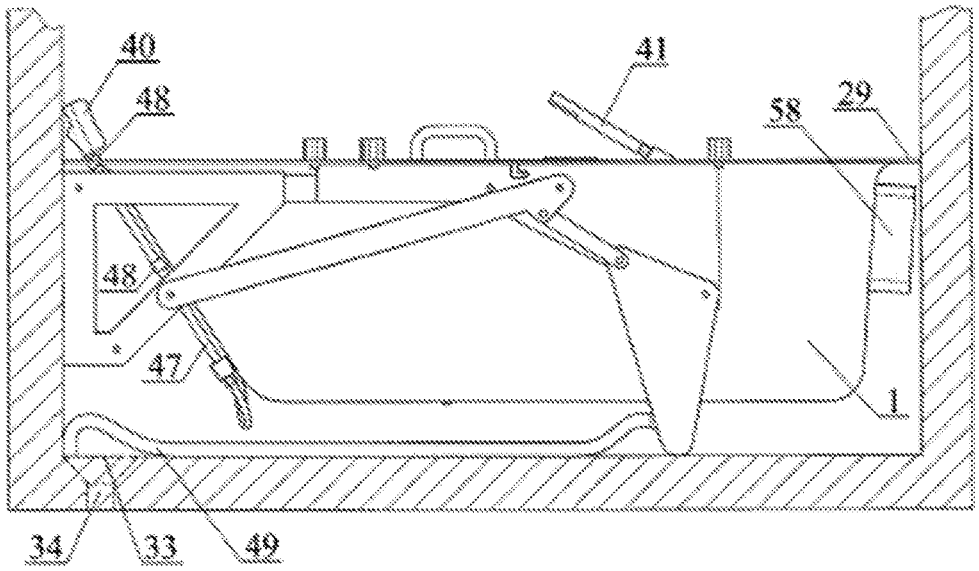
FIG. 8 presents the side view of the bathtub assembly with massage fittings, showing the shower heads, with the four-bar linkage with oscillating links mechanism (the rocker mechanism) and the sewage removal flexible tube.

FIG. 7 and FIG. 8 present, accordingly, the top view and the side view of the bathtub 1 equipped with massage and shower fittings. The nozzles 38 and 39 are arranged in the bottom of the bathtub 1. They are characterized in that they are fed with pressurized air or water, when the bathtub is in the horizontal position, and only with water, when the bathtub is in the vertical position. The nozzles 39 are used to massage calves of the bathing person in the horizontal position and to shower massage thighs in the vertical position, or, when the bathing person sits on the surface 59, to massage the back. The nozzles 38 are used to massage thighs in the horizontal position of the bathtub 1, and in the vertical position, to massage the back when the bathing person stands. The nozzles 37, arranged in the wall 60 of the bathtub 1, administer pressurized water and serve for intensive back massage or at the lower pressure to fill the bathtub 1 with water. In the vertical position they can be used as the upper shower for the person sitting on the wall 59.

Each group of nozzles can be provided with the valve 42 for nozzles 37, the valve 43 for nozzles 38 and the valve 44 for nozzles 39, in order to control the flow intensity, Additionally, to control the massage function, on the rim 29 of the bathtub 1 could be arranged a control panel 63 used to choose a massage program and containing an inclination detector 64 to modify massage functions dependent whether the bathtub 1 is in its horizontal or vertical position. A compressor and a pump (not shown) together with a control system could be arranged on an external side of the bathtub 1, e.g., on the external side of the wall 59. On the rim 29 of the bathtub 1, near the handle 24, there could also be arranged a hand shower head 41 with a flexible feed tube and its control valve 65 (FIG. 7). The complete system could be controlled by the main valve 45 and the common thermostat 46 having a function switch to feed the shower head 40 or 41, or to fill the bathtub. Instead of the switch one can use an inclination sensor and a control system with electromagnetic valves, or a gravitational two-way valve.

Figure 9:
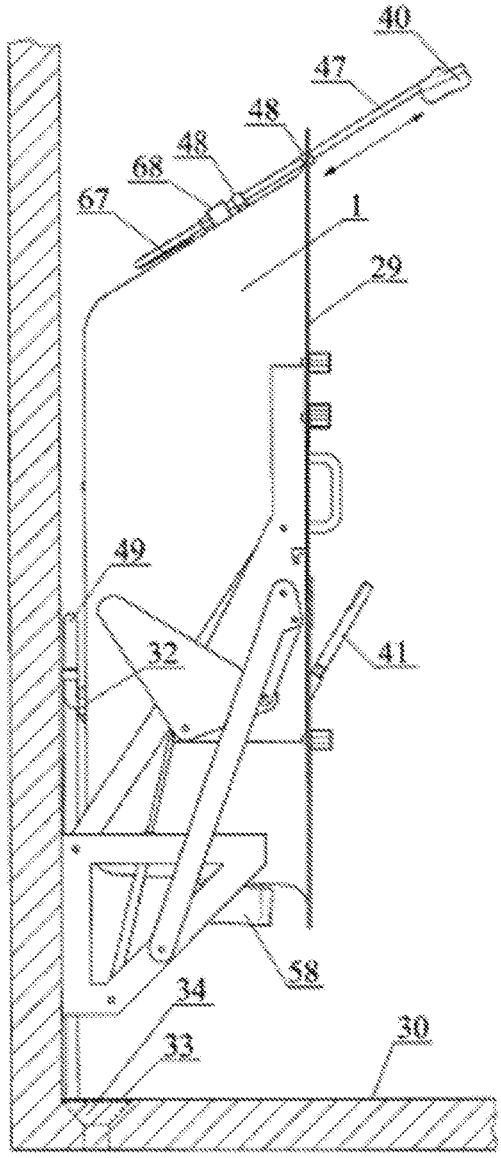
FIG. 9 presents the side view of the bathtub assembly with massage fittings, in the vertical position, showing a method of sliding out the shower head, and the flexible tube for the sewage removal in the vertical position.
Figure 10:
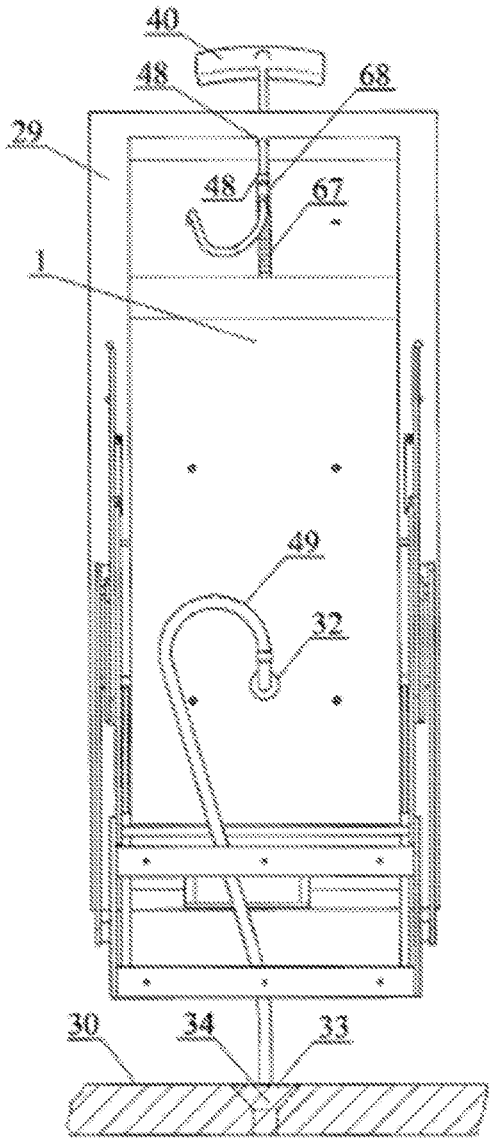
FIG. 10 presents the back view of the bathtub assembly, showing the rocker mechanism, the advanced shower head and the sewage removal flexible tube.

FIG. 9 presents the side view of the bathtub assembly with massage fittings, in the vertical position, showing a method of sliding out the shower head 40, and the flexible tube 49 for the sewage removal in the vertical position, and FIG. 10 presents the back view of the bathtub assembly, showing the rocker mechanism, the advanced shower head 40 and the sewage removal flexible tube. As shown in these figures, the bathtub 1 may be provided with the shower head 40 fixed to the rim of the bathtub 1 on the side of the wall 60 in such way, that when the bathtub 1 is in the horizontal position, the shower head 40, owing to its shape, can constitute a headrest for the bathing person (FIG. 14). In the vertical position it can be advanced to the height greater than 2 m, so it can be used as an upper shower for the person standing next to the bathtub 1 (FIG. 15). The shower head 40 can be displaced by means of the stiff feed pipe 47, generally parallel to the wall 60 and to the guides 48, and arranged in the upper part of the bathtub 1 in the vertical position. In the vertical position of the bathtub 1, the shower head 40 remains in the chosen position by means of the toothed resistance track 67 and a weight 68, urged by the gravitation force to the toothed resistance track 67 (see FIG. 9 and FIG. 10). When the bathtub 1 is being lowered, the gravitation force disconnects the weight 68 from the toothed resistance track 67 and the head 40 hides with a part of the feed pipe 47 behind the wall 60 of the bathtub (FIG. 8). The head 40 can be also connected by means of a ball joint to the feed pipe 47 having flexible tubes on both its sides, so it is further possible to adjust its position both in the horizontal and in the vertical position of the bathtub 1.

The systems of water and electric connections, as well as control devices, filters and valves, etc., have not been presented here, as they are standard technical solutions.

The bathtub 1 has to be provided with the sewage removal system. In order to use the present disclosure, the room has to be equipped with a water isolation membrane or another structure protecting the architectonic construction against flooding. It is supposed that there is a floor drain 33 in the base 30 (see e.g. FIG. 1), or there is a draining basin (not shown) on the base 30. Possible sealing solutions (for example using a protective apron coupled with the rim 29 of the wall 59 of the bathtub) are not a subject of the present disclosure.

In the present description there are presented two methods of sewage removal from the bathtub. The first method concerns a situation, where a floor drain 33 is arranged in a small distance from the outlet hole 32 of the bathtub 1 in the horizontal position (FIG. 1, FIG. 2, FIG. 7 and FIG. 8). If the floor drain 33 is situated within 0.3 m radius from the center of the projection of the outlet hole 32 of the bathtub 1 to the base 30, the outflow from the bathtub 1 can be equipped with an adaptation system comprising two elbows and a stiff pipe 51, and ending with a mushroom discharge outlet 35, protecting against water splashes on the base, with a diameter corresponding to that of the floor drain 33 of the siphon 34 (FIG. 1), concentrically foldable to a basically flat shape when the bathtub is in the vertical position in order to reduce the useless space remaining behind the bathtub in the position (FIG. 3). The diameter of the outlet hole 32 can be adjusted to the evacuation capacity of the siphon 34 used in the base 30. In case when the floor drain 33 is in a different place one can use a flexible tube 49 (FIG. 8, FIG. 9 and FIG. 10).

Owing to that, the whole mechanism can be stored next to external walls, below the rim of the said bathtub, the present device can be, without difficulties, provided with cover plates not obstructing the operation of the mechanism. They comprise the cover plate 52 on the frame 6 of the mechanism and the cover plate 53 on the bathtub 1, protecting the user against the injuries and for decoration purposes (FIG. 14 and FIG. 15).

Figure 16:
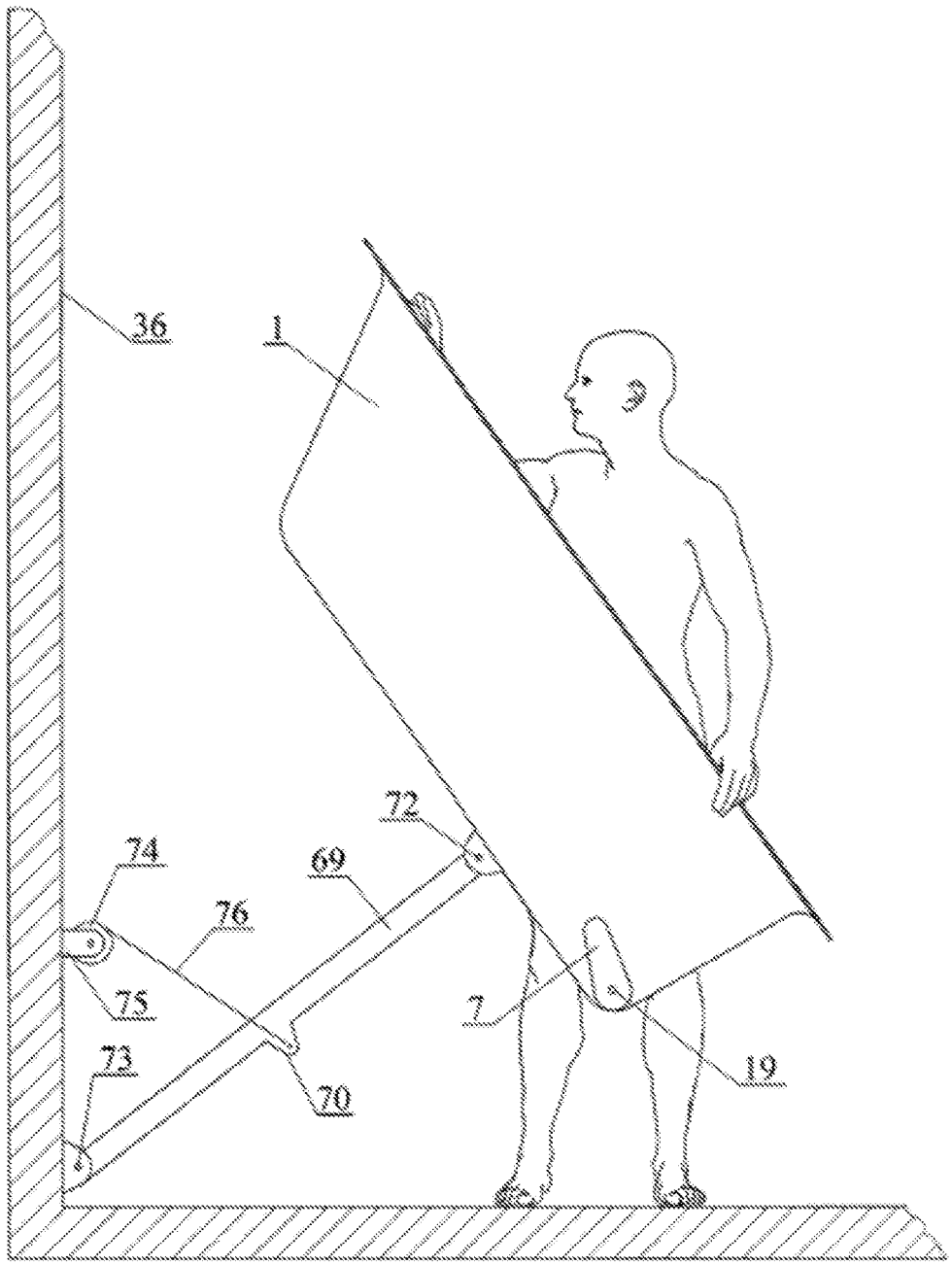
FIG. 16 presents the side view of the bathtub assembly with one lifting arm, a tie and a cylinder, operated manually, in the transfer position, between the horizontal position and the vertical position.
Figure 17:
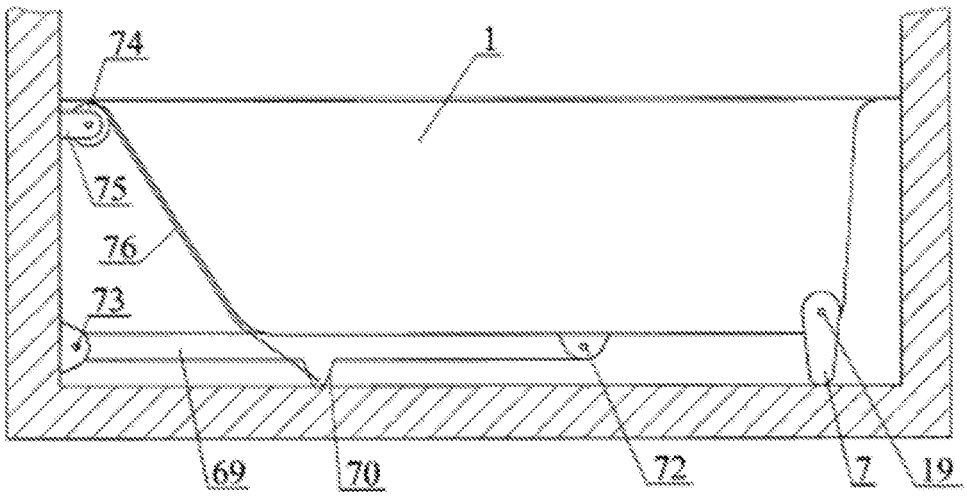
FIG. 17 presents the side view of the bathtub assembly with one lifting arm, a tie and a cylinder, in the horizontal position, and with unfolded legs.
Figure 18:
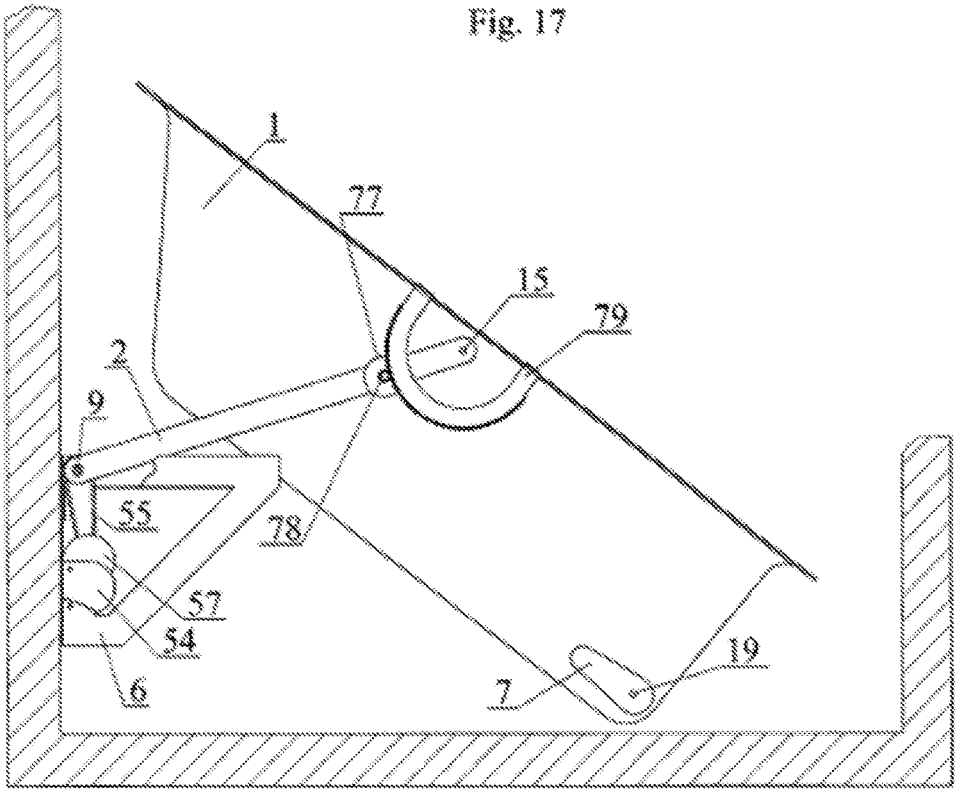
FIG. 18 presents the side view of the bathtub assembly, in the transfer position, between the horizontal position and the vertical position, with the uncovered mechanism comprising a pair of driving arms rotated by a motor, with a servomechanism controlling the bathtub inclination.

FIG. 16 presents the side view of the present bathtub assembly with one lifting arm, a tie and a cylinder, operated manually, in the transfer position, between the horizontal position and the vertical position, FIG. 17 presents the same assemble with the bathtub 1 in the horizontal position, and with unfolded legs 7, and FIG. 18 presents the side view of the bathtub assembly, with the bathtub 1 in the transfer position, between the horizontal position and the vertical position of the bathtub 1, with the uncovered mechanism comprising a pair of driving arms 2 rotated by a motor 54, with a servomechanism controlling the bathtub 1 inclination.

The bathtub 1 (FIG. 17) in the horizontal position is in direct contact with the wall 36 by means of its shorter, gently rising side 60. In this configuration, the arm 69 moving the bathtub 1 is coupled at one end to an articulated joint 72 outside the bottom of the bathtub 1, in its axis of symmetry, and at the other end, via the articulated joint 73, to the base 30 or to the wall 36, in such way that it is basically parallel to the base 30 and perpendicular to the wall 36. The bathtub 1 weight is, at least partially, supported by the said arm, and transferred by the projection 70 of the arm 69 to the base 30. The length of the arm 69 is bigger than half of the length of the bathtub 1, The bathtub 1, in its remaining part, is supported on the foldable legs 7, by means of articulated joints 19 arranged near the lower part of the shorter wall 59 with greater steepness and in the given configuration is farther from the articulated joint 73 of the arm 69 fixed to the wall. A tie 76 (or a pair of parallel ties 76) is fixed to the arm 69, in the place remote from the wall 36, at the height equal or smaller than the height of the bathtub 1. It runs to a reeling cylinder 74 (or to reeling cylinders) arranged on the wall 36 by means of a fixture 75, just under the rim 29 of the bathtub 1. The reeling cylinder 74 can be driven from any source, but in this case, it is driven by a combination of a manual force, a gravitation force and a spring placed in the said cylinder.

After folding the legs 7 of the bathtub 1, the operator applies the force to the rim 29 (FIG. 16) in the vertical direction causing, together with the force created along the tie 76 due to it being reeled on the rotating cylinder 74, lifting of the arm 69 together with the bathtub 1. Directed by the operator, with the help of the spring in the reeling cylinder 74, the bathtub 1 is moved along an arc, defined by the rotation of the arm 69 and its articulated joint 72 in the bathtub 1, in the direction of the wall 36 until the arm 69 rests on the wall.

FIG. 18 presents an embodiment with an electric drive of the pair of arms 2 by means of the motor 54, with transmissions 55, 56 and 57 (see also Fig,5) with an electric servomechanism (not shown) comprising a motor 77 fixed to the arm 2, with a transmission synchronizing the rotation of the arm 2 and the bathtub 1, comprising a gear 78 mounted on the axis of the motor 77 with a gear sector 79 fixed to the bathtub 1 concentrically with the articulated joint 15 of the arm 2 fixed to the bathtub1. The speed of the motor 77 can be controlled, for example in such way, that the angular speed of the rotation of the given bathtub 1 would be twice the angular speed of the rotation of the lifting (leading) arms 2 and in the opposite direction.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A movable bathtub assembly comprising a bathtub and a mechanism to displace it comprising two pair of arms, each pair of arms on the opposite side of the bathtub (1), whereas each pair of arms (2,3) is connected at a first end, via a frame (6,50), to a base (30) and/or to a wall (36) by a first pair of articulated joints (9, 11) and is connected at a second end, via a bed (4), to the bathtub (1) by a second pair of articulated joints (15, 16), wherein all arms, joints and mechanism mounting structures are arranged below an upper edge (29) of the bathtub (1) supported by bathtub legs (7) on the base (30) and situated in the bathing position, about horizontally having a center, completely inside a space defined by the upper edge (29) of the bathtub (1), the base (30) and walls (36) adjacent to the bathtub (1), in such way, that the bathtub is displaced following the rotation of the two pair of arms (2, 3) from a bathing position to a vertical position, where a concave side of the bathtub faces towards the place of the center of the bathtub when in the bathing position, whereas the arms and the bathtub (1) form a four-bar linkage with oscillating links defining the bathtub (1) trajectory, wherein the movement of the arms (2, 3) is synchronised on both sides of the bathtub (1) by a stiff connection of one arm (2, 3) from the first pair to the corresponding arm (2, 3) from the second pair by a coupling element (10).

2. The movable bathtub assembly according to claim 1, wherein the arms (2, 3) are displaced by at least one from the following: a motor, an actuator, manually, a spring and/or their combination.

3. The movable bathtub assembly according to claim 1, wherein it comprises a pair of legs (7) connected to the bathtub (1) by articulated joints (19), directly or indirectly via the bed (4), foldable by mechanism arms, directly or indirectly via a leg coupling element (8).

4. The movable bathtub assembly according to claim 1, wherein it comprises at least one of the following elements: bathtub (1) handles (24), an installation system (21, 28, 80) coupling the bathtub (1) with the mechanism frame (6) along the bathtub (1) lateral sides and a lock (12, 14, 25, 26, 27) blocking the bathtub (1) in the bathing position and in the vertical position.

5. The movable bathtub assembly according to claim 1, wherein the bathtub (1) in the bathing position is used for air-water massage and the bathtub (1) in the vertical position is used for shower massage, comprising, in any combination, elements chosen from the group comprising: water and air nozzles (37, 38, 39), valves (42, 43, 44), a thermostat (46), a hand shower head (41) with a grip, situated on a rim (29) of the bathtub (1) and provided with a flexible feed tube, a main switch valve (45) directing the water flow, a control panel (63) to choose and control the massage function, a feed-control system, and a bathtub inclination detector (64).

6. The movable bathtub assembly according to claim 1, wherein the bathtub (1) is provided with a sliding shower head (40) mounted on a rim (29) of the bathtub (1), on a wall (60) side, having such shape that it provides a headrest for a bathing person, when the bathtub (1) is in the bathing position, whereas in the vertical position it is moved out to such height that it can be used as an upper shower by a person standing next to the bathtub (1), whereas while lowering the bathtub (1) to the bathing position it is stowed away behind the bathtub (1) wall (60).

7. The movable bathtub assembly according to claim 1, wherein a sewage removal system connects a bathtub (1) outlet hole (32), in the bathing position, to a sewage outflow point in the base (30), via the system comprising pipes (51) and/or flexible tubes (49) and a mushroom discharge outlet (33) concentrically folded in the vertical position of the bathtub (1).

8. The movable bathtub assembly according to claim 1, wherein a bathtub lower wall (59), in the vertical position of the bathtub, is situated with its central part at such height above the base (30) and has such shape in its central part that it constitutes a seat.

9. The movable bathtub assembly according to claim 1, wherein it comprises protective and decorative cover plates (52, 53) covering the bathtub (1) side walls and the mechanism on both sides of the bathtub (1).

* * * * *